US007861474B2

(12) United States Patent
Houle et al.

(10) Patent No.: US 7,861,474 B2
(45) Date of Patent: Jan. 4, 2011

(54) CEILING ATTACHMENT FOR FULL-HEIGHT PANEL

(75) Inventors: Alain Leo Houle, Calgary (CA); Charine Ella Roy, Calgary (CA); Steven Charles McIlvenna, Calgary (CA)

(73) Assignee: Haworth, Inc., Holland, MI (US)

( * ) Notice: Subject to any disclaimer, the term of this patent is extended or adjusted under 35 U.S.C. 154(b) by 148 days.

(21) Appl. No.: 12/288,488

(22) Filed: Oct. 21, 2008

(65) Prior Publication Data

US 2010/0095615 A1 Apr. 22, 2010

(51) Int. Cl.
*E04B 2/74* (2006.01)
*E04B 2/00* (2006.01)

(52) U.S. Cl. ..... 52/242; 52/64; 52/126.3; 52/126.4; 52/241; 52/243.1; 52/745.09

(58) Field of Classification Search ..... 52/64, 52/238.1, 241, 481.2, 126.3, 126.4, 243.1, 52/745.09, 242
See application file for complete search history.

(56) References Cited

U.S. PATENT DOCUMENTS

| | | | | | |
|---|---|---|---|---|---|
| 1,716,625 | A | * | 6/1929 | Dawson | 52/243.1 |
| 3,423,892 | A | * | 1/1969 | Rimington | 52/241 |
| 3,967,420 | A | | 7/1976 | Papsco et al. | |
| 4,086,734 | A | | 5/1978 | Hayashi | |
| 4,103,463 | A | * | 8/1978 | Dixon | 52/126.4 |
| 4,151,691 | A | * | 5/1979 | Wendt | 52/242 |
| 4,434,596 | A | | 3/1984 | McAteer et al. | |
| 4,667,450 | A | | 5/1987 | Stefnik et al. | |
| 5,010,702 | A | * | 4/1991 | Daw et al. | 52/241 |
| 5,125,203 | A | * | 6/1992 | Daw | 52/241 |
| 5,140,792 | A | * | 8/1992 | Daw et al. | 52/238.1 |
| 5,159,793 | A | | 11/1992 | Deugo et al. | |
| 5,228,254 | A | * | 7/1993 | Honeycutt, Jr. | 52/241 |
| 5,377,467 | A | | 1/1995 | Barnavol | |
| 5,471,805 | A | * | 12/1995 | Becker | 52/241 |
| 5,524,402 | A | | 6/1996 | Sykes | |
| 5,875,596 | A | * | 3/1999 | Muller | 52/239 |
| 6,047,508 | A | | 4/2000 | Goodman et al. | |
| 6,115,978 | A | | 9/2000 | Bastian et al. | |
| 6,122,871 | A | | 9/2000 | Russell et al. | |
| 6,634,149 | B2 | | 10/2003 | Cates et al. | |
| 7,093,398 | B2 | | 8/2006 | Spransy et al. | |
| 7,624,549 | B2 | * | 12/2009 | Kopish | 52/243.1 |
| 2002/0189172 | A1 | * | 12/2002 | Kaeser et al. | 52/64 |
| 2009/0223141 | A1 | * | 9/2009 | Behrens | 52/64 |

FOREIGN PATENT DOCUMENTS

GB 20 49 013 A * 12/1980

* cited by examiner

*Primary Examiner*—Robert J Canfield
(74) *Attorney, Agent, or Firm*—Flynn, Thiel, Boutell & Tanis, P.C.

(57) ABSTRACT

A prefabricated wall panel has a top frame structure defining an upward-opening channel extending lengthwise along the upper edge of the panel. An elongate header member is normally disposed within this channel. The header member is vertically slidably supported on supports fixed to the top frame structure so that the header member, in a storage position, is retained in the space. When the panel has been swung upwardly so that the upper edge is aligned below a preinstalled ceiling track, then the header member is manually displaced upwardly until the header telescopes over the ceiling track. A fixed connection is then formed between the header and the ceiling track to provide lateral stability at the upper edge of the wall panel.

18 Claims, 11 Drawing Sheets

CEILING ATTACHMENT FOR FULL-HEIGHT PANEL

FIELD OF THE INVENTION

This invention relates to an improved header arrangement which cooperates between a ceiling and an upper edge of a prefabricated upright wall panel for permitting securement of the wall panel in an upright position relative to a floor.

BACKGROUND OF THE INVENTION

It is conventional practice to subdivide large open areas into smaller work spaces or offices by erecting upright walls constructed from a plurality of prefabricated upright wall panels which are horizontally serially joined in aligned or angled relationship to define the desired wall structure. While the prefabricated wall panels are sometimes of short height so as to project upwardly from the floor through significantly less than floor-to-ceiling height, nevertheless in many instances the need is to define work spaces or offices which provide greater privacy, or closure along hallways and the like, thereby requiring prefabricated wall panels which are of floor-to-ceiling height. Walls employing full height prefabricated wall panels, however, present greater difficulty with respect to installation and securement of the upright prefabricated panels, particularly with respect to the ceiling.

Typically, when installing a full-height wall defined by prefabricated wall panels, the ceiling, which is often a drop-type ceiling of conventional construction, is provided with a track structure secured thereto. This track structure, frequently in the form of a shallow downwardly-opening channel, is positioned to create an overlapping engagement with an upper structure associated with the prefabricated upright wall panel so as to provide lateral stability and hence maintain the panel in the desired upright relationship. The attachment structure associated with the upright wall panel, and its cooperation with a track structure attached to the ceiling, however, has often created structural and installation complexities.

In some known arrangements, attaching the upper edge of the prefabricated full-height panel to the ceiling involves what is referred to as a "scoop in" attachment process. In this regard, as the panel is tilted upwardly into an upright position, which tilting occurs in a sideward direction with respect to the panel, the upper edge of the panel must be guided upwardly into a downwardly opening ceiling track as the lower edge of the panel is sidewardly displaced into its desired floor location. Since the panel is typically of greater height than the clearance below the ceiling track, this installation technique typically results in slight upward lifting of the track and the attached drop ceiling until such point as the upper edge of the panel is properly engaged within the track and the panel is disposed substantially in its desired upright position, at which time the ceiling and attached track drop down so as to restore its original position while at the same time creating a lateral retention between the ceiling track and the upper edge of the panel. This installation process can be difficult to carry out, and more significantly is considered undesirable due to the necessity of creating localized upward lifting of the drop ceiling.

To avoid the "scoop in" attachment technique as briefly described above, other full-height prefabricated wall panels have been provided with separate attachment members associated with the upper edge thereof, such as upwardly slidable plates or swinging arms which must be manually released, after the panel has been positioned in an upright position below the track, so that the plates or arms move upwardly into the track to provide lateral restraint along the upper edge of panel. These arrangements, however, are generally difficult to install in that they require one or more installers to effect manual release or movement of the sliding plate or arms, which are typically provided adjacent opposite upper corners of the panel, in order to permit engagement with the ceiling track adjacent opposite upper corners of the panel.

In addition, panel constructions of this latter type are typically provided with removable trim strips which attach to upper edges of the panel and which extend therealong so as to reduce the clearance gap which exists between the upper edge of the panel and the ceiling, both visually and acoustically. The trim strips, however, cannot both be attached prior to the panel being pivoted upwardly into its upright position since they interfere with access to the attachment structure. Hence, at least one of the trim strips must be manually attached to the upper edge of the panel after the panel has been disposed in its upright position and attached to the ceiling. This further complicates the installation of the wall system.

In many of the known prefabricated full-height wall panel constructions of the aforementioned type, the wall panel is provided with a horizontally-elongated header associated with the upper edge of the panel. This header, during installation, is moved upwardly to create an engagement with a guide track which is fixed to the ceiling. In many of the known constructions, the elongate header is supported on elongate struts which connect to the header adjacent opposite ends, and which protrude downwardly for telescopic support within the frame of the wall panel. These struts frequently telescope downwardly for engagement with the upright edge rails of the panel frame. While these constructions do permit the header to be raised and lowered so as to perform the desired function, nevertheless these constructions unnecessarily and undesirably complicate the overall structure of the panel. In addition, access to the struts during installation of the panel, particularly since such panels must also be joined edge-to-edge during the installation process, is made more difficult. Some of these arrangements attempt to simplify the problem of accessing the struts by utilizing springs which urge the header upwardly, but this itself creates additional problems with respect to release of the springs and upward urging of the header only when the panel is disposed in precise alignment below the ceiling track. These general arrangements hence have failed to provide desired structural and operational simplicity coupled with minimization of manufacturing costs.

Examples of known constructions which relate generally to prefabricated wall panels having a movable top header associated therewith are illustrated by U.S. Pat. Nos. 3,967,420, 4,086,734, 4,434,596, 4,667,450, 5,159,793, 5,377,467, 5,524,402, 6,047,508, 6,115,978, 6,122,871, 6,634,149, 7,093,398.

Accordingly, it is an object of this invention to provide an improved header arrangement for cooperation between a ceiling and an upper edge of a prefabricated full-height wall panel so as to provide simplified installation and improved appearance and improved sealing cooperation with the ceiling, thereby overcoming various disadvantages associated with most previously provided constructions.

More specifically, this invention relates to an improved header arrangement which cooperates between a ceiling and an upper edge of a prefabricated upright panel, which header arrangement provides a low profile while at the same time permits the prefabricated panel to be vertically sidewardly tilted into position below a preinstalled ceiling track so as to permit cooperation therewith without requiring a "scoop in" connection technique, whereby the improved arrangement permits utilization of small or minimal clearances so as to minimize the required space for such arrangement along the top of the panel, while at the same time facilitating and minimizing the installation technique for attaching the upper edge of the panel to the preinstalled ceiling track, including permitting the ceiling trims as attached to upper edges of the panel to be mounted on the panel prior to upward swinging of the panel into its desired installed position.

SUMMARY OF THE INVENTION

In the improved upright wall arrangement of the present invention, the upper edge of the prefabricated wall panel is provided with a top frame member which extends lengthwise of the panel and which mounts, adjacent opposite sides thereof, elongate trim parts which extend lengthwise along opposite sides of the top frame member and protrude upwardly a limited extent so as to be exteriorly visible from either side of the wall panel when in its upright condition. The trim parts can be fixed to the top frame member prior to the panel being tilted into its upright installed position. The trim parts define therebetween an upwardly-opening channel-like space which extends lengthwise along the upper edge of the panel, and an elongate header member is normally disposed within this space. The header member is vertically slidably supported on supports which are fixed to the top frame member so that the header member, when in a storage position, is retained in the space between the side trim parts. When the panel has been swung upwardly so that the upper edge thereof is vertically aligned below the preinstalled ceiling track, then the header member is manually displaced upwardly until an upper part of the header engages the fixed ceiling track. A fixed connection is formed between the header and the ceiling track to provide lateral stability at the upper edge of the wall panel. The header preferably mounts seal strips adjacent the upper wall thereof which preferably create areas of sealing engagement with the ceiling adjacent opposite sides of the ceiling track. The header also preferably has additional sealing strips which cooperate with the side trim parts to create a seal therebetween so that a substantially full closure exists between the ceiling and the wall panel.

Figure 1:
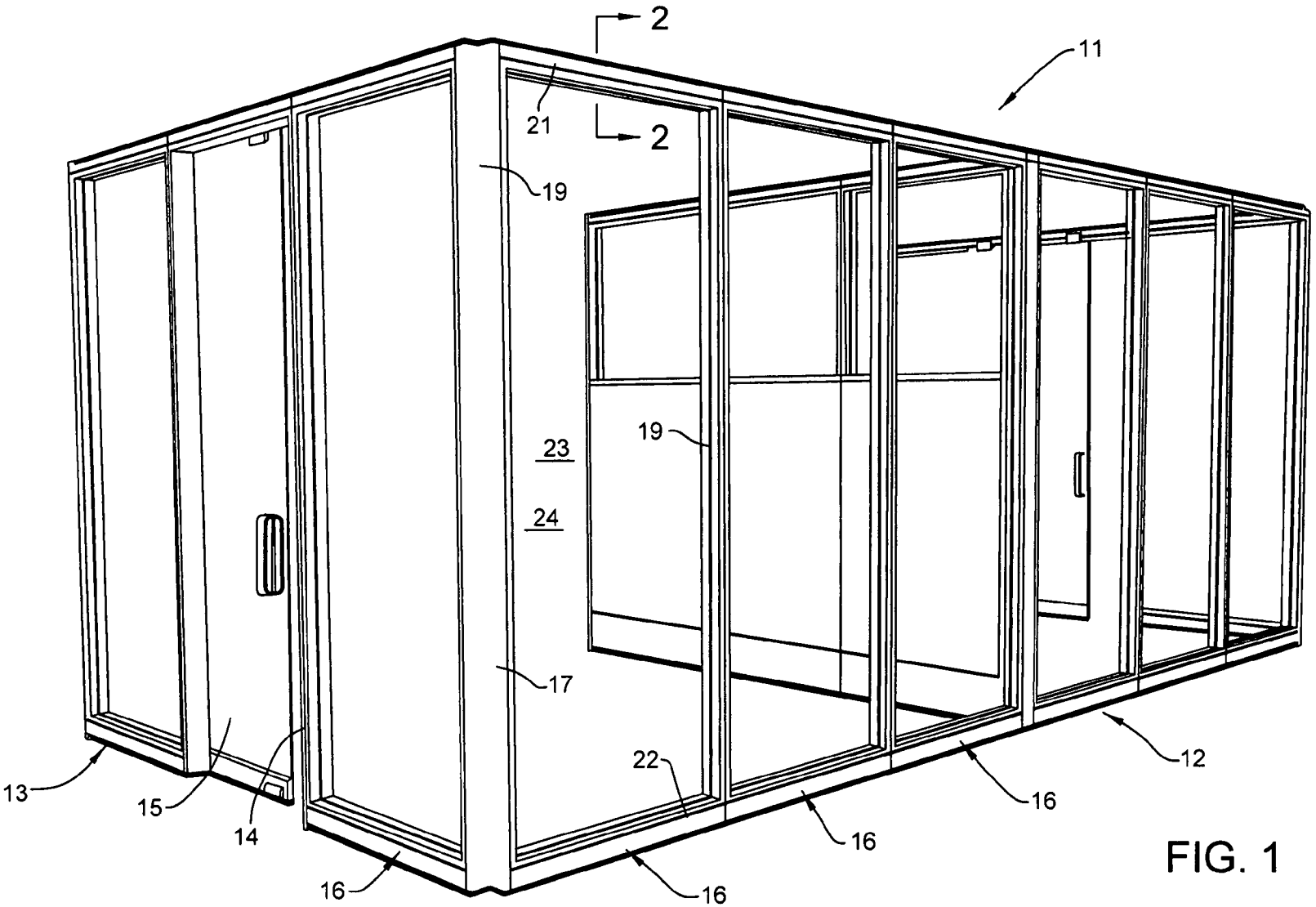
FIG. 1 is a fragmentary perspective view of a wall system formed from a plurality of full-height prefabricated upright wall panels, which wall panels incorporate features in accordance with the present invention.

Certain terminology will be used in the following description for convenience and reference only, and will not be limiting. For example, the words "upwardly", "downwardly", "rightwardly" and "leftwardly" will refer to directions in the drawings to which reference is made. The words "upwardly" and "downwardly" will also refer to the conventional directions or orientations associated with the upright panels when they are disposed in a supportive upright relationship between a floor and a ceiling. The words "inwardly" and "outwardly" will refer to directions toward and away from, respectively, the geometric center of the panel and of designated parts thereof. Said terminology will include the words specifically mentioned, derivatives thereof, and words of similar import.

DETAILED DESCRIPTION

Referring to FIG. 1, there is illustrated a prefabricated upright wall system 11 intended for support on a floor within a building, and which may cooperate with additional fixed or prefabricated movable walls to assist in dividing a large open area into smaller areas used for offices and the like. The upright wall system 11 may include a plurality of walls which interconnect in angled relationship, such as the walls 12 and 13 illustrated in FIG. 1, and may also include a doorway 14 having a sliding door arrangement 15 associated therewith.

A wall constructed in accordance with the present invention is typically formed by a plurality of prefabricated upright wall panels 16 which can be joined edge-to-edge in either aligned or angled relationship, with the connection between the edges of adjacent panels being accomplished using any one of many known conventional techniques. The prefabricated wall panels 16, in the illustrated arrangement, are intended to be "full height" panels, namely wall panels having a height which generally corresponds to the floor-to-ceiling height associated with a building. The prefabricated wall panel 16 includes a rigid ring-shaped outer frame 17 defined by sidewardly spaced and generally parallel upright (i.e. side) frame elements 19 which, at opposite ends, are rigidly joined by generally horizontally extending and generally parallel top and bottom frame members 21 and 22, respectively. The center or opening defined by the ring-shaped outer frame is in turn suitably covered by sheet-like covering members extending vertically thereacross, the covering in the illustrated embodiment being accomplished by a glass sheet 24, the edges of which are supported in a generally conventional manner within rail structures or channels associated with the respective frame members. It will be appreciated, however, that the glass sheet 24 may be replaced by a sheet of any other suitable material, or in the alternative the frame may be formed so as to permit cover pads or sheets to be attached to opposite exterior sides thereof, such being conventional, with one example of such construction being illustrated by U.S. Ser. No. 11/636,878, as owned by the Assignee hereof.

Figure 2:
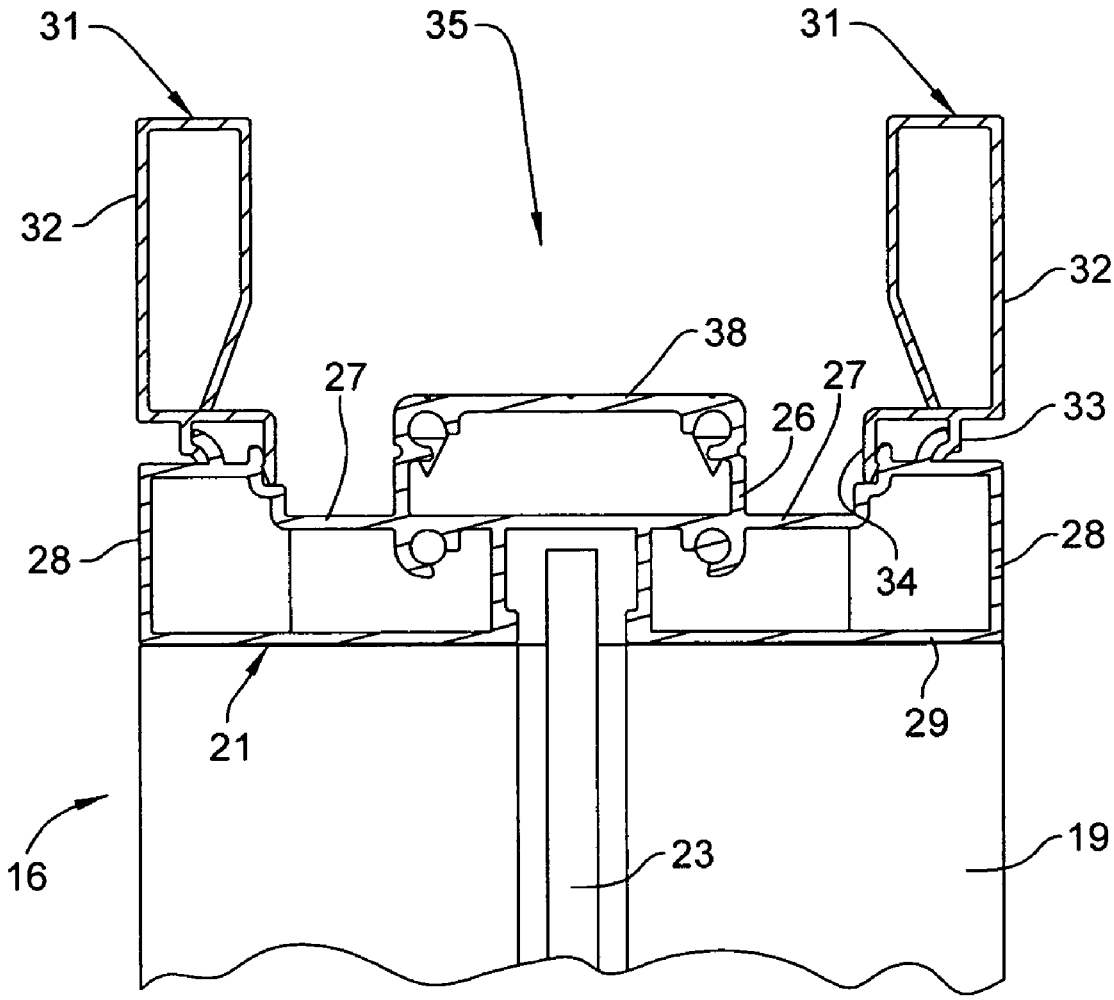
FIG. 2 is an enlarged fragmentary sectional view illustrating the top frame construction associated with the prefabricated wall panel, as taken generally along line 2-2 in FIG. 1.
Figure 3:
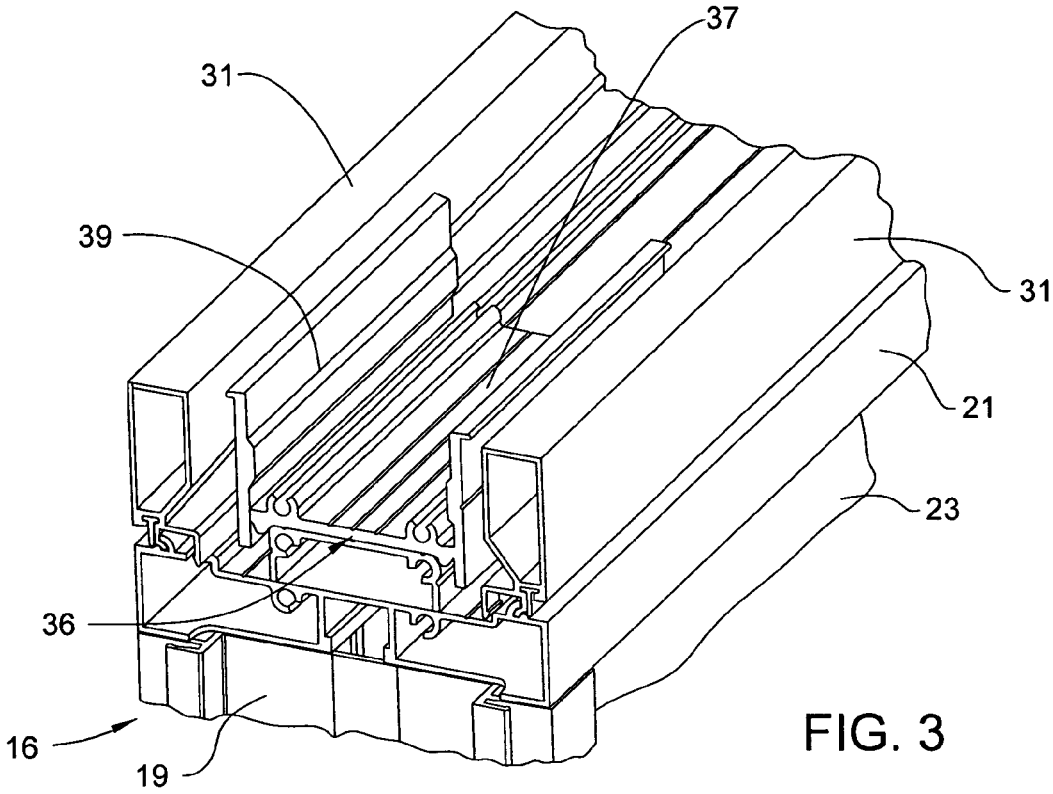
FIG. 3 is a fragmentary perspective view illustrating one upper corner of a prefabricated wall panel, and showing a support member which attaches to the top frame and which provides support for a top header member (not shown).
Figure 4:
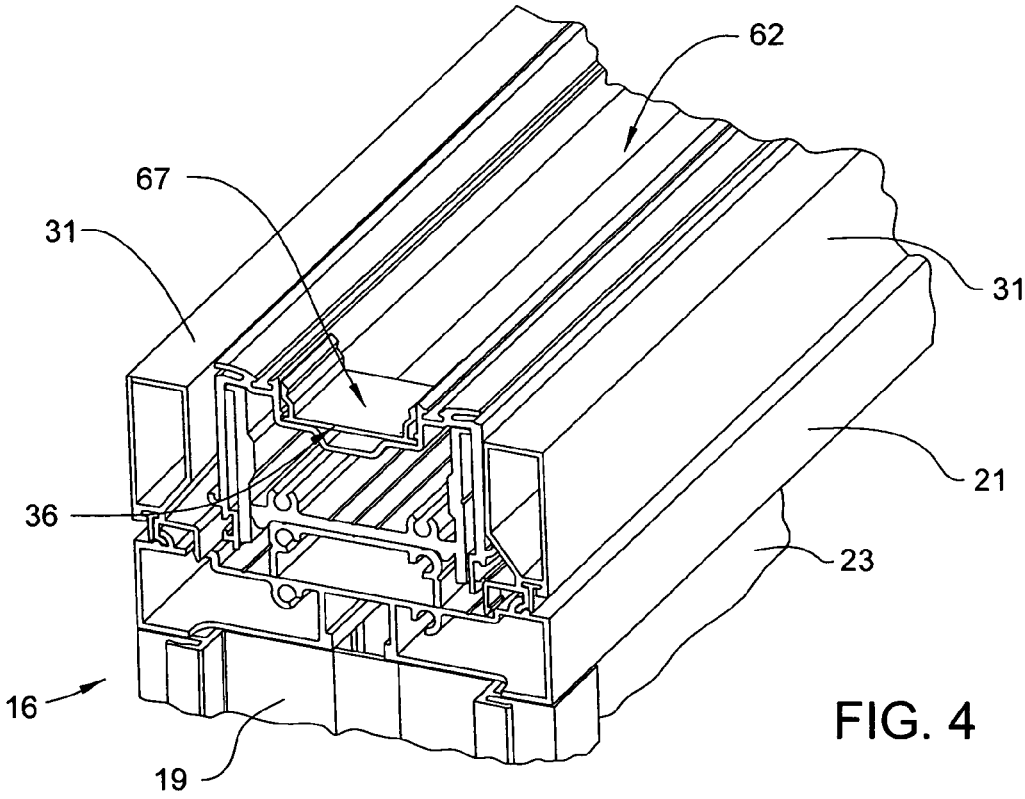
FIG. 4 is a view similar to FIG. 3 but showing the manner in which the top header member is nestingly supported on the support member and cooperates with the top frame of the wall panel when the header member is in its recessed or storage position.
Figure 8:
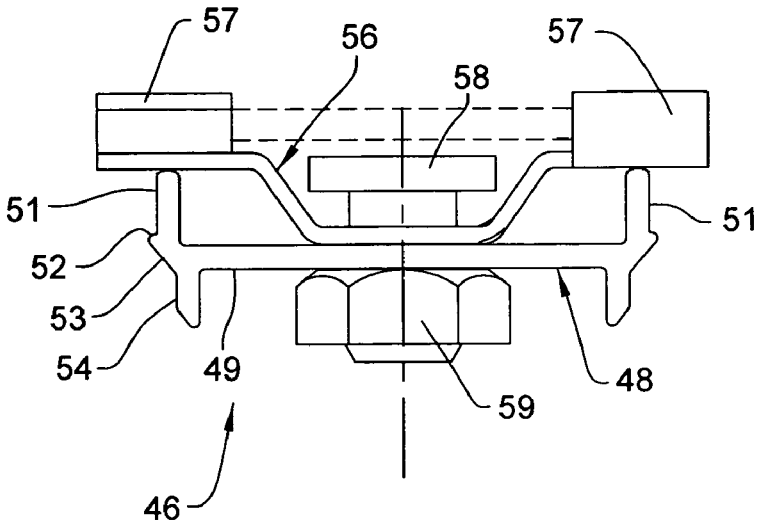
FIG. 8 is an enlargement of solely the ceiling track as shown in FIG. 6.
Figure 5:
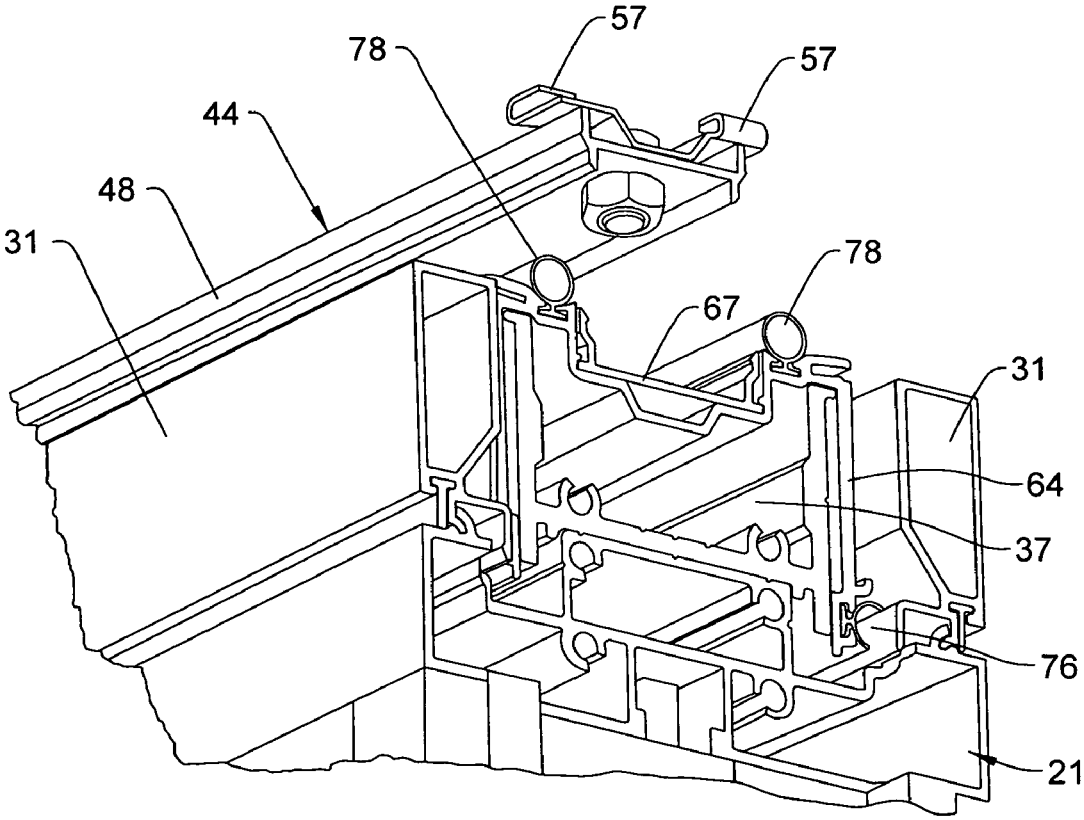
FIG. 5 is a fragmentary perspective view which illustrates the upper corner of the wall panel with the header assembly mounted thereon similar to FIG. 4, but which is viewed in an upward direction to illustrate the disposition of a ceiling track structure thereabove.

The top frame member 21 of the prefabricated wall panel 16, in the embodiment illustrated by FIG. 2, is defined by a horizontally elongate hollow member, such as an extruded aluminum member, having a generally tubular center part 26 which is rigidly joined to and protrudes slightly upwardly relative to a pair of tubular edge parts 27, the latter defining thereon upright side walls 28 which define opposite exterior sides of the top frame member. The top frame member 21 has a generally flat and horizontally extending bottom wall 29 which, to accommodate an edge of the center panel 23, is formed with a conventional groove extending lengthwise thereof.

The top frame member 21 mounts thereon a pair of upper trim parts 31 which, in this illustrated embodiment, are detachably carried on and protrude upwardly from the respective tubular edge parts 27 so as to be disposed adjacent and extend lengthwise along opposite sides of the panel. For this purpose, the trim parts or members 31 are horizontally elongate so as to extend lengthwise along the full length of the panel 16, and each trim part 31 includes a vertical side face 32 which is substantially co-planar with the adjacent exterior side of the top frame member so as to provide a compatible visual appearance. The trim part 31, at its lower end, defines a hook 33 which protrudes downwardly therefrom, and an inner cantilevered leg part 34 which also protrudes downwardly. The hook 33 and leg part 34 cooperate with opposed hooks and shoulders defined on the tubular edge part 27 associated with the top frame member 21 so that trim parts 31 can be engaged with the hooks on the edge parts 27 and then rotated into an upright position substantially as illustrated by FIG. 2 to create a rigid snapped engagement with the frame member 21. When the trim parts 31 are mounted on the top frame member 21 substantially as illustrated in FIG. 2, they effectively define a rather large upwardly-opening channel-shaped configuration, which configuration (i.e., the frame member 21 and trim parts 31) can be of a one-piece construction if desired. This configuration defines, sidewardly between the trim parts 31, a rather large open region or space 35 which projects upwardly away from the frame member 21 to accommodate a movable header structure as described hereinafter.

Referring now to FIGS. 3-8, there is illustrated a header/track arrangement 44 which cooperates between a ceiling and an upper edge of the prefabricated wall panel 16 for permitting securement therebetween to provide lateral stability at the upper edge of the upright wall panel.

Figure 6:
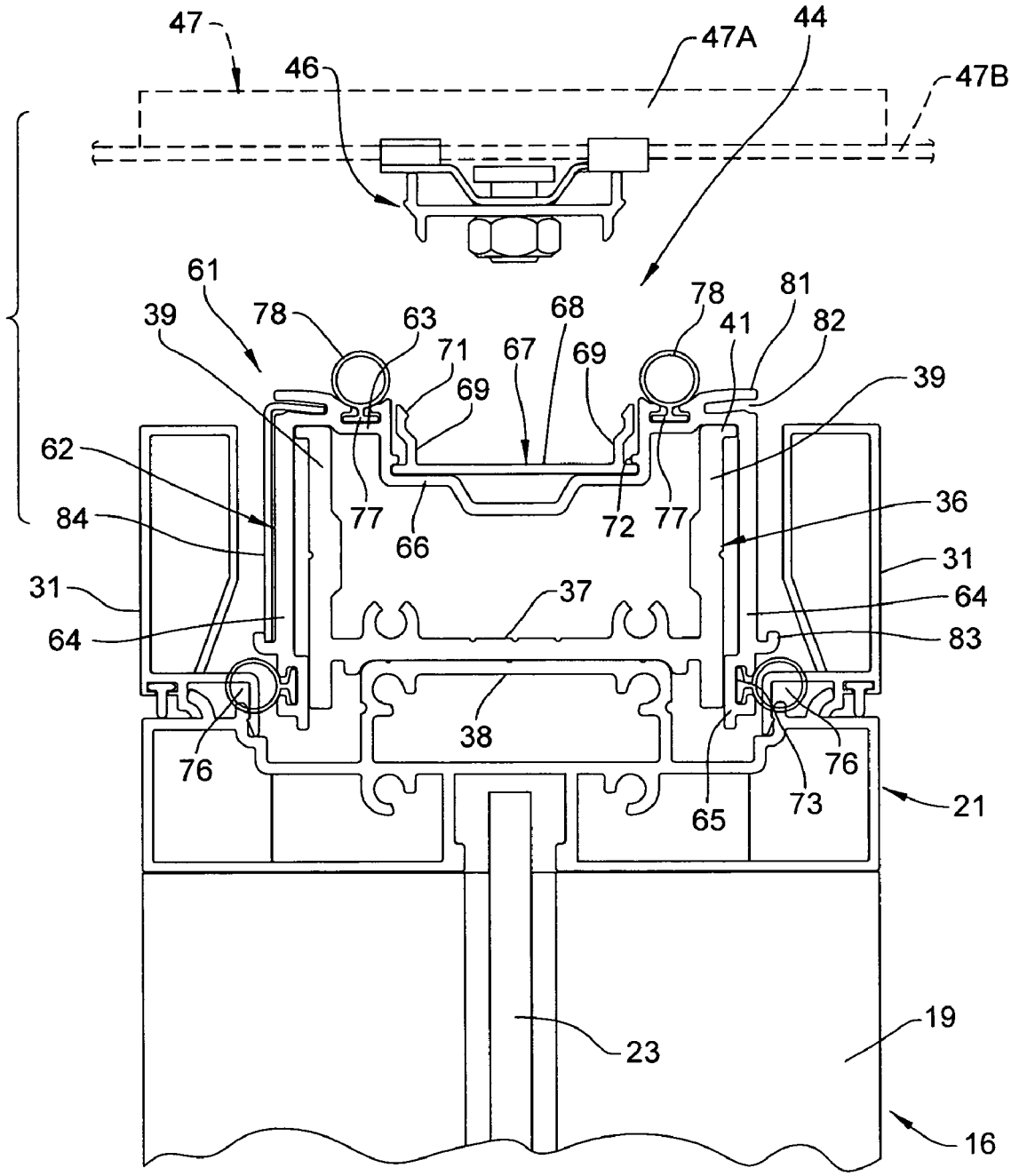
FIG. 6 is an enlarged, fragmentary, cross-sectional view which illustrates the upper edge of the wall panel disposed in an upright disposition below a ceiling track, and showing the header assembly in its lowered disengaged position relative to the ceiling track.

Referencing FIG. 6, the header/track arrangement 44 includes a track 46 which is attached to the face of a ceiling 47 so as to extend therealong at a location corresponding to the desired disposition of the wall. The ceiling 47 in the illustrated arrangement is a conventional drop ceiling defined by ceiling tiles 47A which are supported on ceiling tracks or rails 47B.

The track 46 includes a horizontally elongate track member 48 having a base wall 49 which is generally horizontally oriented and which, in the illustrated embodiment, has a pair of upwardly-protruding edge flanges or legs 51 extending lengthwise thereof and protruding upwardly substantially for abutting engagement with the ceiling 47. The base wall 49 has a further pair of sidewardly spaced and generally parallel flanges 54 which extend lengthwise of the track member and protrude downwardly to create a generally downwardly-opening channel-shaped configuration. The bottom flanges 54 are, in the illustrated arrangement, positioned slightly inwardly relative to the top flanges 51, and on the exterior side thereof are provided with a cam surface 53 which slopes outwardly and upwardly and terminates in a sideward protrusion 52 defining thereon an upward facing shoulder, the latter being positioned generally at the elevation of the base wall 49.

The track 46, at selected locations along the channel member 48, is also provided with attachment clips 56 which are intended for releasable engagement with the ceiling rail 47B to permit fixed attachment of the track 46 to the ceiling. The attachment clip 56 includes a sidewardly spaced pair of channel-shaped engagement parts 57 which are secured to opposite ends of the clip 56. The engagement parts, due to their channel-shaped configuration, can be horizontally displaced into engagement with an edge of the ceiling rail 47B.

To attach the clip 56 to the track member 48, the center portion of the clip is rotatably supported on but held downwardly in contact with the base wall 49 by means of a center support pin 58 which has a head part at the upper end, and a tightenable nut 59 on the lower end. When the nut 59 is loosened, the clip 56 can be angularly displaced relative to the track member to swingably move the engagement parts 57 into engagement with the ceiling rail 47B. When so engaged, the nut 59 is tightened to rigidly secure the clip 56 relative to the track member 48, and hence rigidly secure the track 46 relative to the ceiling 47.

The header/track arrangement 44 also includes a header assembly 61 (FIGS. 6 and 7) which is carried on and extends lengthwise along the upper edge of the prefabricated wall panel 16, and which is intended for fixed engagement with the track 46 after the latter is installed on the ceiling 47.

The header assembly 61 includes a horizontally elongate header member 62 formed generally as an inverted channel-shaped member. The header member 62 in turn is vertically slidably supported on a support structure or member 36 which is fixed to the top frame member 21 and which protrudes upwardly into the space defined between the side trim parts 31 so as to permit storage of the header member 62 within this space when the header member is in a lowered storage position substantially as illustrated by FIG. 6.

The support structure 36 in the illustrated arrangement comprises a short channel-shaped beam section which has a bottom wall 37 which overlies and is fixedly secured, as by means of screws or bolts, to the top wall 38 defined on the tubular center part 26 of the top frame member 21. The bottom wall 37 in turn joins to a pair of side walls or legs 39 which are cantilevered upwardly in generally parallel relationship and which are respectively disposed adjacent but spaced laterally inwardly a small distance from the inner side walls of the respectively adjacent side trim members 31. Each of the side legs 39, adjacent the upper edge thereof, is provided with a protrusion or flange 41 which projects sidewardly toward the adjacent side trim member 31. Flange 41 functions as a stop, as explained hereinafter.

The support structure 36 typically include a pair of substantially identical or similar support beam sections which are fixed to the top frame member 21 adjacent opposite ends thereof, and hence cooperate with opposite ends of the channel-shaped header member 62. It will be recognized, however, that the support 36 can be a single elongated member extending substantially throughout the length of the top frame member 21 if desired. In situations where the header is provided for association with a frame structure extending across a doorway opening, an elongate one-piece support member 36 provides increased strength and rigidity.

The inverted channel-shaped header member 62 is shaped and sized so as to nest over the supports 36 when the header 62 is in the lowered storage position illustrated in FIG. 6. For this purpose, the header member has a top wall 63 which extends transversely across the width of the support 36, and which joins to a pair of generally parallel side walls or flanges 64 which are cantilevered downwardly. These side flanges 64 are sidewardly spaced apart by a distance which slightly exceeds the width of the support 36 so that the flanges 64 are disposed exteriorly of and effectively enclose the side walls 39 of the support 36. The header side flanges 64, adjacent lower free ends thereof, are provided with flanges 65 which protrudes inwardly to create an area disposed generally for slidable guiding contact with an exterior surface of the adjacent support side wall 39.

The top wall 63 of header member 62 has a depressed channel-shaped part 66 formed centrally thereof and extending lengthwise therealong. This channel part 66 supports therein, adjacent each end of the elongate header member 62, a snap-type engagement member 67 which is adapted to create a releasable engagement with the track 46 when the header member 62 is moved into the raised position illustrated by FIG. 7.

The engagement member 67 includes a base wall 68 which extends transversely across the width of the channel part 66, and is retained within the channel part by small protrusions 72 which protrude inwardly from the channel part and overlap the edges of the base wall 68. The engagement member 67 also has a pair of sidewardly-spaced and generally parallel spring legs or clips 69 cantilevered upwardly therefrom, with each of the spring legs 69 adjacent the upper free end thereof being provided with a sidewardly projecting hook part 71. The spring legs 69 are preferably constructed of a resiliently deflectable material, such as a plastics material, and are sidewardly spaced by a distance which enables the spring legs 69 to be moved upwardly so as to exteriorly telescope over the bottom flanges 54 formed on the track member 46. This upward movement causes the hook parts 71 to engage the cams 54 which effect outward deflection of the spring legs 69 whereupon the hook parts 71 pass upwardly over and then spring back into engagement above the shoulders 52. The snap-type engagement member 67 can be made from metal, such as spring steel or aluminum, to provide increased strength in gripping if deemed necessary or desirable, but such member 67 will still retain its resilient snap-engagement capability.

The top wall 63 of header member 62, adjacent opposite sides of the center channel part 66, has elongate undercut grooves 77 formed in and extending lengthwise therealong. These grooves are generally T-shaped in cross-section and accommodate therein a generally T-shaped securing strip which is mounted on and protrudes lengthwise along an elongate seal strip 78 so as to permit securement of the seal strip 78 to the top wall of the header member adjacent each side of the top wall. The pair of seal strips 78, which in the illustrated embodiment are illustrated as deformable bulb strips, extend lengthwise along the top wall of the header member in sidewardly spaced relationship, with the sideward spacing of the seal strips 78 being such as to permit the seal strips to contact the ceiling adjacent opposite sides of the track 44.

Each of the side legs 64 of the header member 62, adjacent the lower edge thereof, is also provided with a generally T-shaped undercut groove 73 which opens through the outer side face and which accommodates therein a mounting strip associated with a further elongate seal strip 76. The seal strip 76 extends lengthwise along the lower free edge of each header member side wall 64 and, when the header member 62 is in the raised and engaged position illustrated by FIG. 7, the seal strips 76 maintain a sealed engagement with the inner faces of the side trim members 31. The seal strip 76 is also illustrated as a deformable bulb seal, although it will be recognized that the seal strips 76 and 78 can be constructed in any conventional manner so long as they are capable of providing sufficient deformation to create a sealed engagement with a respectively opposed surface, such as the ceiling or the inside surface of the trim member 31. These seal strips, when the header 62 is in latching engagement with the ceiling track 46, provide not only a sealed relationship which provides improved sound proofing or acoustics with respect to regions located on opposite sides of the wall, but also provide cushioning which is effective in preventing noise due to vibration and the like.

Figure 7:
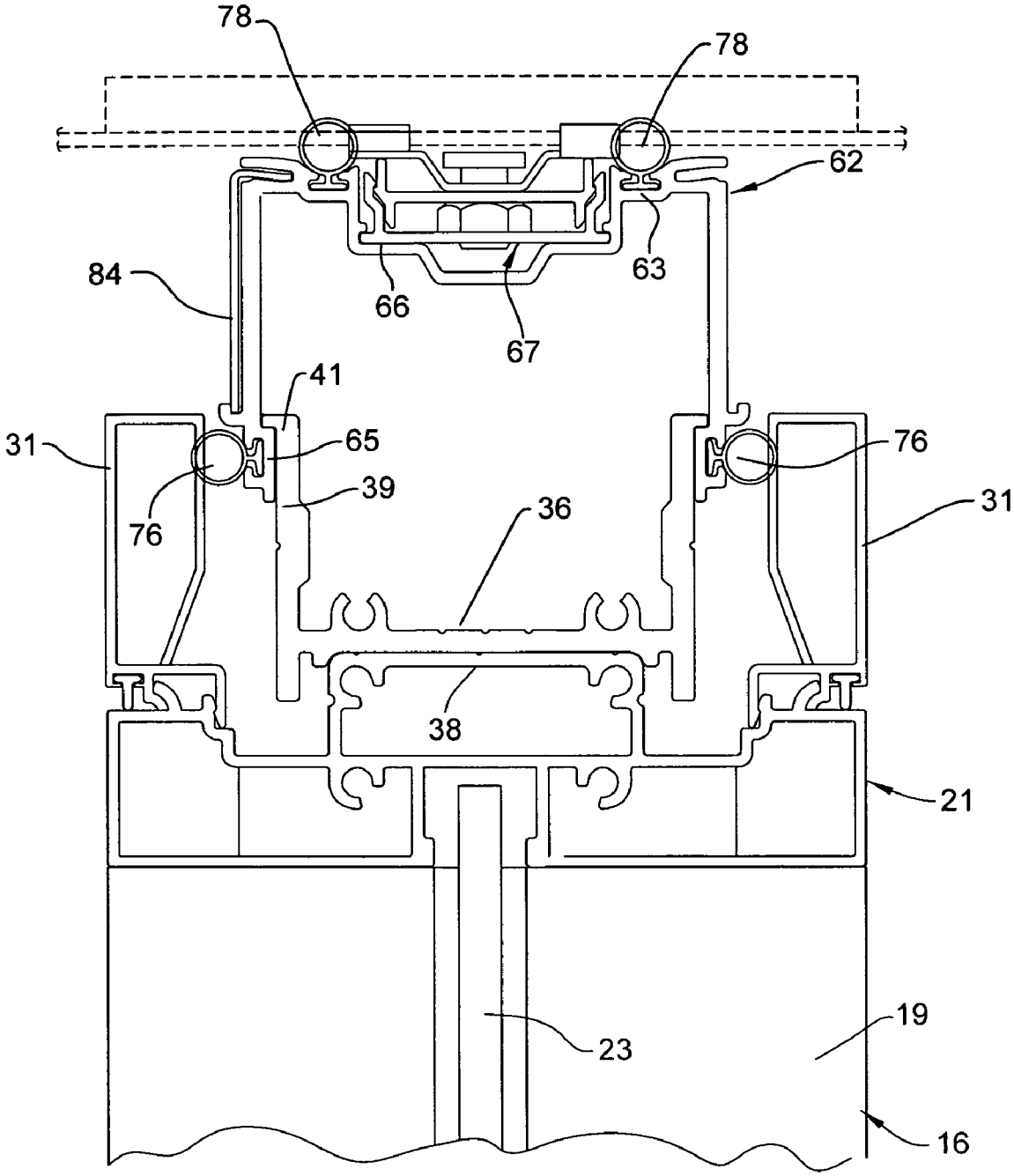
FIG. 7 is a view which corresponds to FIG. 6 but illustrates the header assembly in its raised position so as to be fixedly engaged with the ceiling track.

As illustrated by FIGS. 6-7, the header member 62 also has flanges 81 which are associated with the top wall 63 and extend lengthwise therealong adjacent opposite sides thereof. These flanges 81 and their cooperation with the top wall 63 define lengthwise-extending grooves 82 which open sidewardly along both sides of the header member. Each side wall 64 of the header member also has a small hook part 83 which protrudes outwardly therefrom in the vicinity of the lower edge of the respective leg member, and which extends lengthwise therealong. The groove 82 and the respective hook part 83 are provided to permit a small strip-like trim cover 84 to be positioned on the header member so as to externally overlie the exposed side face of the side wall 64 and hence provide for improved aesthetics. Use of the trim cover 84 is, of course, optional.

The assembly of the wall panel 16 and specifically the assembly and cooperation of the header assembly on the wall panel, and the installation of the wall panel and the structural connection of the header to the ceiling track, will now be briefly described in relationship primarily to FIGS. 6 and 7 so as to ensure a complete understanding thereof.

In view of the structural and functional relationship associated with the header assembly 61 and its cooperation between the track 46 and the wall panel 16, the header assembly 61 in accordance with the present invention can be fully assembled to the prefabricated wall panel 16 at the factory. That is, the supports 36 are initially fixedly secured adjacent opposite ends of the top frame rail 21, and the header assembly and specifically the header member 62, with the bulb seals 76 and 78 mounted therein, can be nested downwardly over the support members 36 so that the upper edges of the support member legs 64 effectively function as stops for supporting the header member 62 in telescopic nested engagement thereover substantially as illustrated in FIG. 6. In addition, both side trim members 31 can be mounted on the top frame rail 21 to permit complete assembly of the wall panel 16 at the factory, or at least prior to erection of the wall at the job site, which assembly is substantially as illustrated in FIG. 6. The trim strips 84, if utilized, can be either shipped separately, or mounted on the header at the factory and then removed or mounted at the job site if necessary.

With the wall panel 16 fully assembled at the factory and having the header assembly mounted thereon substantially as illustrated in FIG. 6, the overall height of the assembled panel is such that it can be positioned so that the lower edge is substantially directly under the preinstalled ceiling track 46, and the panel is then manually sidewardly tilted upwardly so as to position the upper extremity of the assembled panel directly under the ceiling-mounted track 46. This positioning of the panel can be easily and manually accomplished since the construction of the assembled panel is such as to avoid any structural interference with the ceiling track. Thereafter the installers manually slidably displace the header member 62 upwardly toward the ceiling track 46 until the spring legs 69 engage and then move upwardly a sufficient distance to allow the hooks 71 to snap into position above the shoulders 52, thereby vertically fixing the engagement clips 67, and hence the header member 62, in a raised position wherein it is structurally engaged vertically between the upper edge of the panel 16 and the ceiling-mounted track 46. When so engaged, the upper sealing strips 78 are also substantially engaged with the ceiling adjacent opposite sides of the track 46 to provide improved acoustics with respect to transmission of noise and air between opposite sides of the panel.

Referring now to FIGS. 9-13, there is illustrated a preferred variation of a header/track arrangement 44' which cooperates between a ceiling and an upper edge of the prefabricated wall panel 16' for permitting securement therebetween to provide lateral securement and stability at the upper edge of the wall panel. In this modified arrangement of FIGS. 9-13, parts of this modified arrangement are designated by the same reference numeral used to designate corresponding parts of the arrangement illustrated in FIGS. 3-8, except for the addition of a prime (') thereto. Because of the significant structural and functional similarity between the FIGS. 3-8 and FIGS. 9-13 arrangements, the following description will relate principally to the structural and functional differences associated with the FIGS. 9-13 arrangement.

Figure 9:
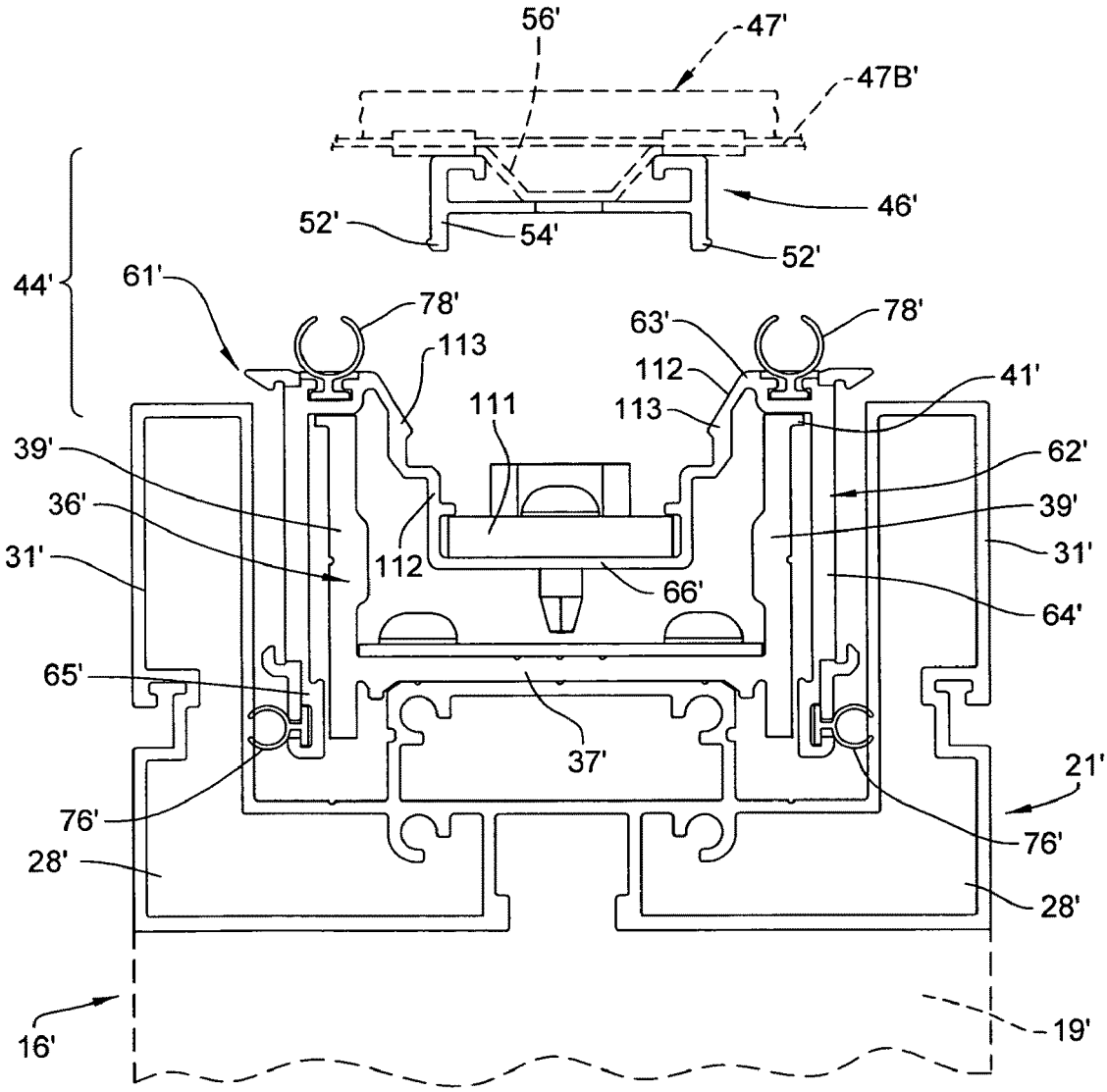
FIG. 9 is an enlarged fragmentary cross-sectional view similar to FIG. 6 but illustrating a preferred variation of the invention, and showing the header assembly in this preferred variation in its lowered disengaged position relative to the ceiling track.

As illustrated in FIG. 9, the track 46' is similar to the track 46 as previously described, and attaches to the ceiling in generally the same manner. The side legs of the track 46', however, are generally straight and the downwardly protruding side flanges 54' have the sidewardly-protruding projections 52' positioned so as to protrude outwardly generally along the lower free edges of the flanges.

Figure 10:
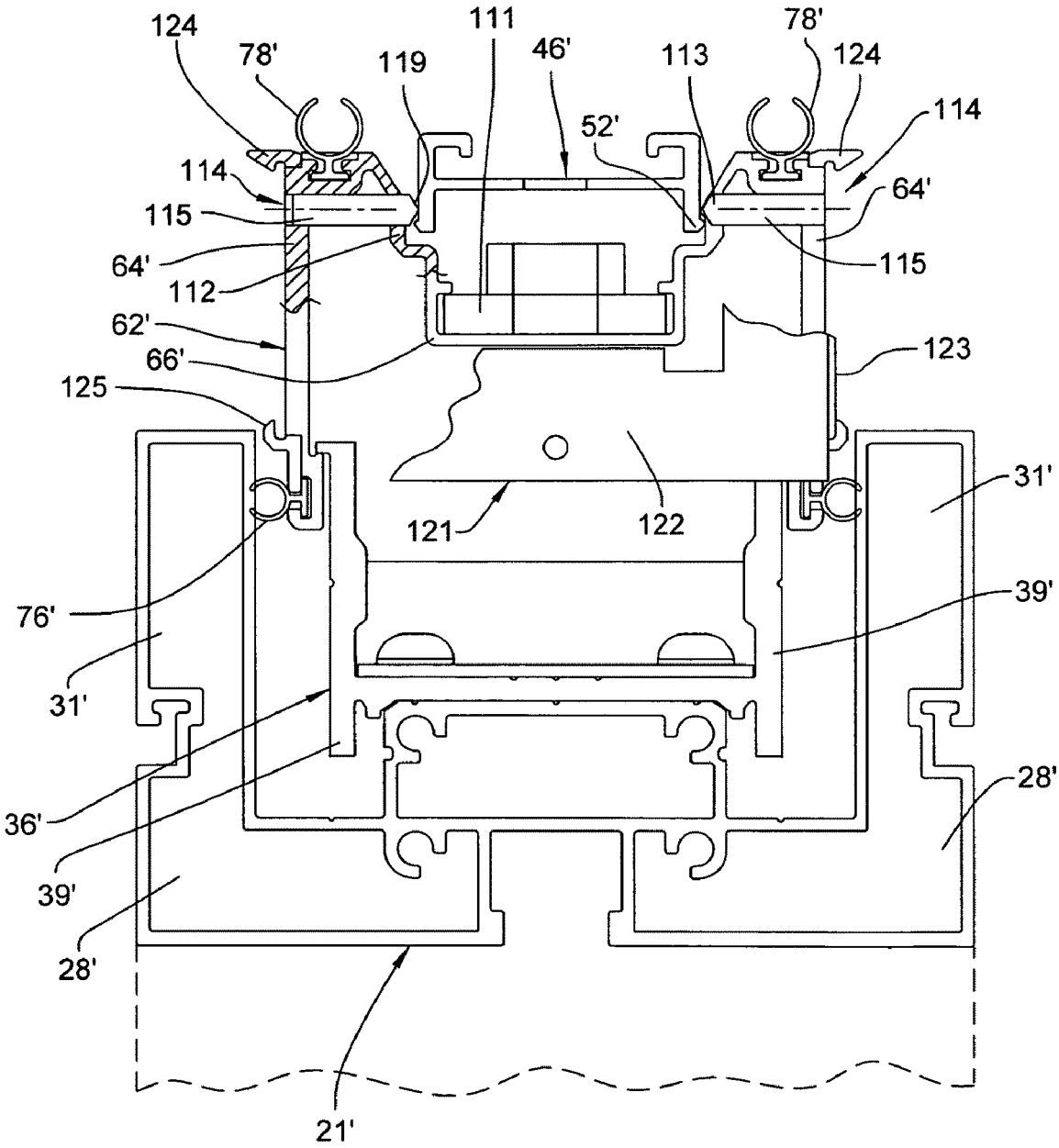
FIG. 10 is a view which corresponds to FIG. 9 but illustrates the header assembly in its raised position for engagement with the ceiling track.

This modified header/track arrangement 44', as illustrated principally by FIGS. 9-10, the header assembly 61' which is carried on and extends lengthwise along the upper edge of the prefabricated wall panel 16' includes a horizontally elongate header member 62' formed generally as an inverted channel-shaped member which is vertically slidably supported on a support structure or member 36', the latter again being defined by a pair of such members 36' which are of short lengthwise-extent and which are fixedly mounted on the top frame member 21' in spaced relationship adjacent opposite ends thereof. The center frame member 21', in this variation, has the side trim parts 31' permanently fixedly attached to the lower side frame parts 28', this being accomplished by formation of these parts as an integral one-piece member, such as an aluminum extrusion.

The header member 62' has the downwardly cantilevered side legs 64' disposed slidably between the respectively adjacent support leg 39' and the respectively adjacent frame trim part 31', with the header legs 64' at their upper ends being joined together by a top wall 63'. This top wall 63' again has a depressed channel-shaped part 66' formed centrally thereof and extending lengthwise therealong so as to provide an upwardly opening channel which accommodates therein the ceiling track 46' when the header assembly is in the raised engaged position illustrated by FIG. 10. To effect structural reinforcement, the center channel part 66' associated with the top wall of the header member can be provided with a reinforcing block 111 confined and structurally fixed to the wall of the channel part to thereby provide additional strength and rigidity.

The depressed channel-shaped center part 66' of the header member 62' has the side walls 112 thereof, in the vicinity of the upper ends of the side walls, provided with enlargements (or protrusions) 113 which protrude inwardly toward one another, with the normal sideward spacing between these opposed protrusions 113 being substantially equal to or only slightly greater than the maximum width defined between the outer extremities of the lower protrusions 52' defined on the ceiling track 46' so as to enable the protrusions 113 to move upwardly above the protrusions 52' when in the raised disposition illustrated by FIG. 10.

Figure 11:
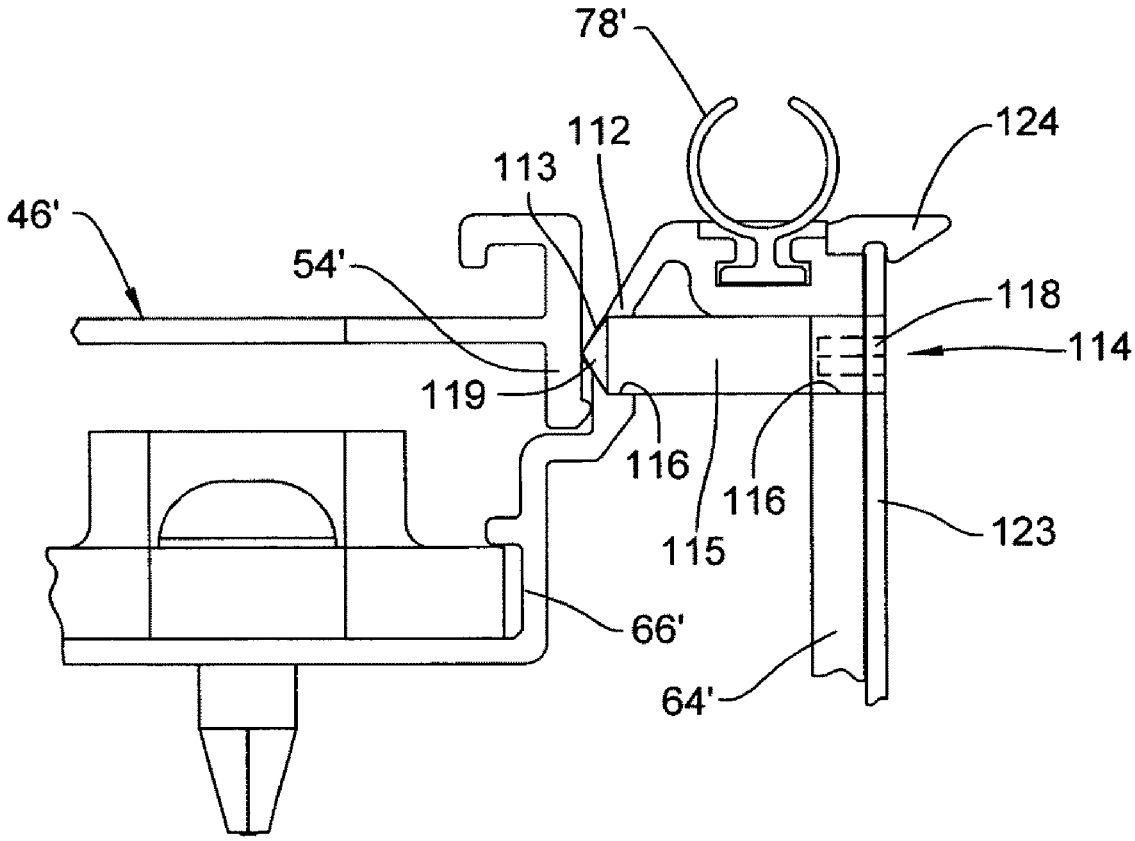
FIG. 11 is a fragmentary enlarged view of a portion of FIG. 10 and showing the header in engaged relationship with the ceiling track.

To permit a fixed and strong securement of the header member 62' to the track 46' when in the raised position shown in FIG. 10, the header member 62' has an engagement structure 114 (FIGS. 10-12) provided adjacent each end of each side leg 64', which attachment structure 114 is positioned in the vicinity of the respective upper corner of the respective side leg. More specifically, this attachment or engagement structure 114 includes a manually-engagable fastener or securing member 115, specifically a threaded set screw, which is threadedly engaged within aligned threaded openings 116 formed in the side wall 64' and the side wall 113 as illustrated in FIG. 11, with the threaded opening 116 in the side wall 112 projecting horizontally through the protrusion 113. The threaded fastener or set screw 115 is disposed so that the head end thereof is engaged within the threaded opening 116 associated with the side wall 64', with the head end of the fastener having a conventional tool-receiving opening 118 associated therewith so as to be accessible exteriorly of the arrangement. The other end of the set screw, namely the conically pointed end 119, is disposed within the other threaded opening 116 associated with the side wall 112, with this pointed end normally being recessed into the opening 116 so as to not protrude outwardly beyond the exterior surface of the protrusion 113.

Figure 12:
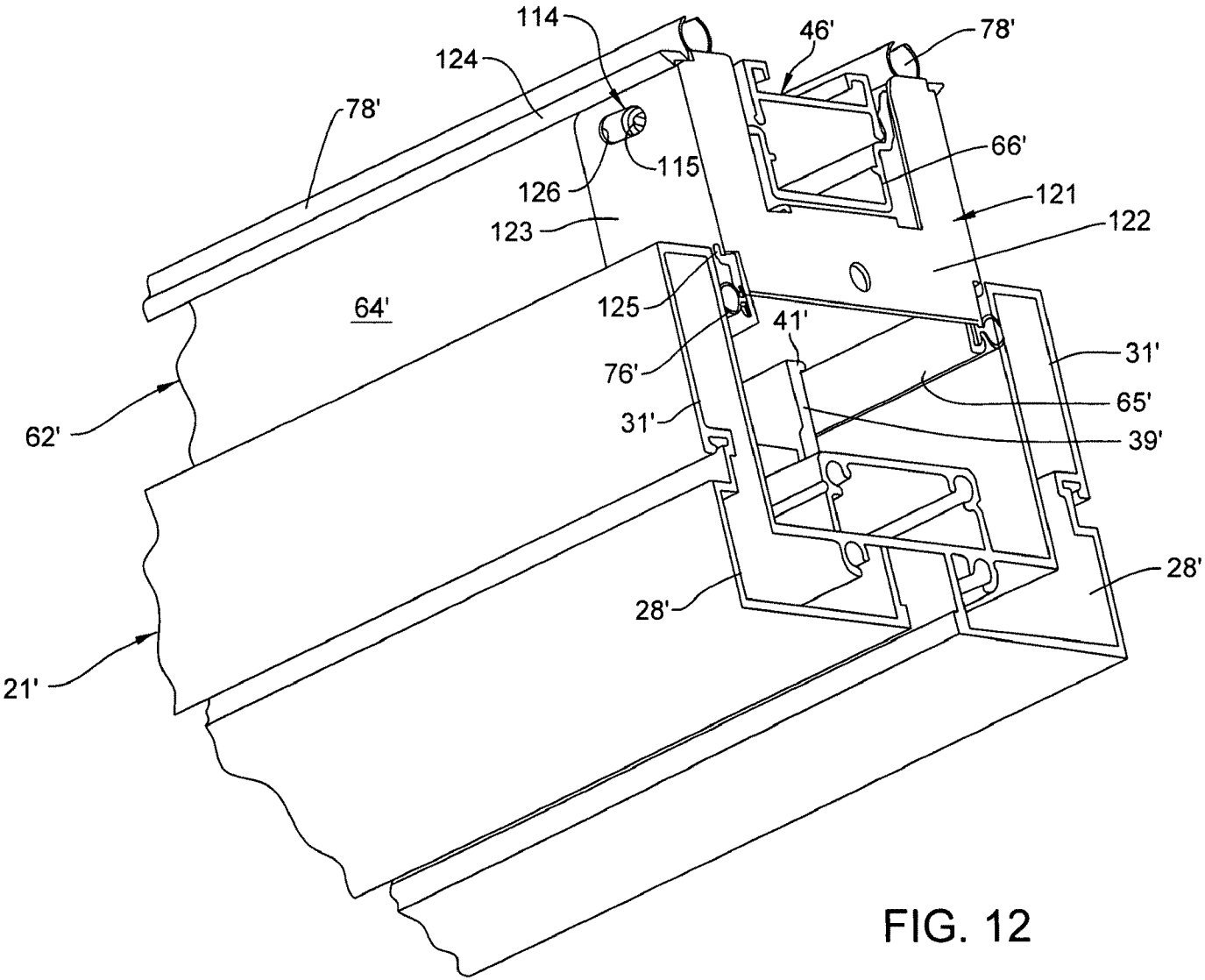
FIG. 12 is a fragmentary perspective view which illustrates one end of the panel top frame and its cooperation with the top header member, the latter being shown in its raised position.

The header assembly variation of FIGS. 9-13 also has an end cap 121 mounted on each end of the header member 62'. This end cap 121, as illustrated in FIG. 12, is generally U-shaped in horizontal cross-section and includes a upright bight wall 122 which extends transversely across the header member and which, at opposite vertical edges, joins to a pair of sidewardly spaced and generally parallel end or edge walls 123 which protrude lengthwise in adjacent but sidewardly straddling relationship to the exterior sides of the header member side legs 64'.

The header member 62' has upper and lower tabs or flanges 124 and 125, respectively, which are fixed to and are cantilevered outwardly (i.e. sidewardly) away from the respective side leg 64' adjacent the respective upper and lower edges thereof. These upper and lower tabs 124-125 define therein vertically opposed grooves which extend lengthwise of the header member and which slidably accommodate therein the respective upper and lower edges of the cap edge wall 123, as partially illustrated in FIG. 11. The confinement of the upper and lower edges of the cap edge walls 123 within grooves defined in the upper and lower tabs 124-125 provides two functions, one being sideward restraint of the end cap 121 so that the latter provides sideward reinforcement against the adjacent header side walls 64' so as to prevent or minimize distortion of these latter walls when the set screws 115 are threaded into engaged relationship with the ceiling track. The end cap 123 is additionally slidably displaceable lengthwise of the header member through a small extent, such as into the outward position illustrated by dotted lines in FIG. 13, to permit the end caps 121 associated with adjacent headers on aligned adjacent panels to be moved outwardly into contacting engagement with one another to thereby close the gap which exists between the opposed ends of the adjacent header members.

Figure 13:
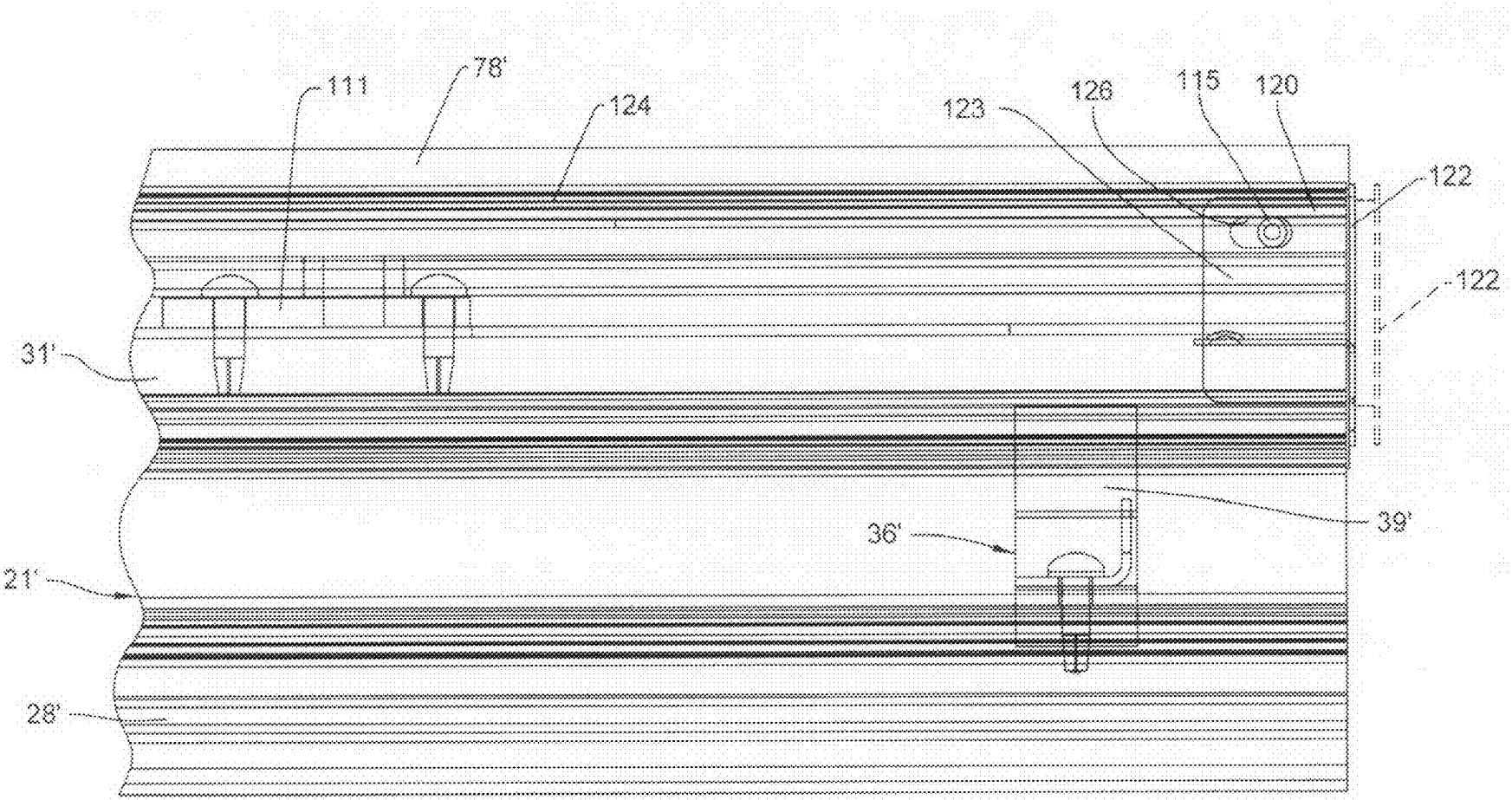
FIG. 13 is a side elevational view of the arrangement shown in FIG. 12.

As illustrated by FIG. 13, each edge wall 123 of the end cap has an elongate slot or access opening 126 extending therethrough so as to provide access to the respective set screw 115. The slot 126 is horizontally elongated so as to provide such access irrespective of the position of the end cap.

To install the wall panel and effect securement of the modified header 62' to the track 46', the panel is again positioned with the lower edge substantially directly under the pre-installed ceiling track, and the panel is then manually sidewardly tilted upwardly so as to position the upper extremity of the assembled panel directly under the ceiling-mounted track 46'. Again, this is easily accomplished since the construction of the assembled panel is such as to avoid any structural interference with the ceiling track.

Thereafter the installer manually slidably displaces the header member 62' upwardly toward the ceiling track 46' and effects tightening of the set screws 115 provided adjacent opposite ends of one of the header member side legs 64' to create a fixed and rigid attachment of the header member 62' to the ceiling track 46'.

More specifically as to the attachment of the header member 62' to the ceiling track 46', a single installer positioned adjacent one side of the upright wall panel can manually lift one end of the header member 62', such as by manually engaging and lifting the top flange 124 until the one end of the header member substantially fully telescopes over the ceiling track, whereby the set screws 115 are now positioned above the protrusions 52' associated with the ceiling track. The installer can then insert an appropriate tool (such as an Allen wrench) into the opening 118 formed in the head end of the respective set screw 115 and then effect rotation of the set screw so that it is moved inwardly into tight contacting engagement with the side flange 54'. As the set screw 115 is tightened and contacts the respective flange 54', this causes the protrusion 113 on the opposed leg of the channel part 66' of the header member to be drawn into snug engagement with the side face of the other ceiling track flange 54' so that the ceiling track is hence snugly transversely engaged on both sides between the activated set screw 115 on one side and the protrusion 113 on the other side.

Thereafter the same installer can then access the other end of the header member 62' and, by engaging the upper tab 124, lift the other end of the header member 62' upwardly so as to telescope over the ceiling track 46', following which the set screw 115 at the other end of the header member is manually activated and moved into gripping engagement with the side flange 54' of the ceiling track so as to effect gripping of the track by the other end of the header member, thereby effecting secure fixed engagement of the track within the header member throughout the full length thereof.

While the installation can be accomplished using a single installer who sequentially lifts and tightens the screw at one end and then does the same thing at the other end of the header member, it will be obvious that such assembly operation could be accomplished more quickly utilizing two installers who respectively substantially simultaneously lift both ends of the header member and who effect substantially contemporaneous rotation of the set screws so as to effect tightening of the header member to the ceiling track.

In view of the nature of the cooperation provided between the header member and the ceiling track, the header member could be provided with only one pair of set screws or fasteners thereon, which pair can be provided on only one of the header member side legs 64' in the vicinity of the opposite upper corners thereof. By providing set screws adjacent the upper corners of both side legs 64' of the header member, however, significantly greater convenience is achieved in that the installer can hence position himself adjacent either side of the wall panel without having to do any specific orientation of the wall panel so as to provide access to the set screws.

Further, by providing set screws adjacent the corners of both header member side walls, a pair of generally aligned set screws are disposed in opposed relationship adjacent each end of the header member, and hence the installer can, if desired, effect tightening or loosening of the set screws disposed on opposite sides of the panel so as to effect a slight lateral shifting of the header member relative to the track. This hence provides the installer with some small adjustability in the lateral position of the upper edge of the panel, such as to provide increased accuracy with respect to the upright relationship of the panel relative to the floor and/or alignment between adjacent panels.

With the arrangements as described above, and as illustrated by FIGS. 6-7 and 9-10, the installation of the wall panels at the job site and specifically the interconnection thereof to the ceiling track is greatly simplified and expedited, and at the same time the resulting arrangement provides improved aesthetics and sealed relationships between the wall panel, the header arrangement and the ceiling. In addition, these advantages are achieved by a structure which is believed to provide improved simplicity with respect to its manufacturability and its assemblage.

While the afore-mentioned prefabricated wall panel incorporating therein the improved header assembly is primarily intended for use in cooperation with a ceiling having an attachment structure such as a track mounted thereon to permit structural attachment between the track and header to provide lateral stability adjacent the upper edge of the panel, it will be recognized that this improved wall panel and height-movable header arrangement can also provide a desirable cooperative engagement with the ceiling in a situation where a direct structural connection to the ceiling is not permitted to desired. More specifically, the improved panel and height-adjustable header arrangement of the present invention can be used to provide a contact or "kiss" type engagement with the ceiling so as to provide the same visual appearance of the wall and the associated privacy aspects, but nevertheless be free of direct structural connection between the ceiling and wall. In this situation, the header 62 can be vertically displaced upwardly so that the upper extremity of the header, and specifically the top seal strips 78, move into contacting engagement with the ceiling, thereby creating a "kiss" type contact which is otherwise free of any direct structural joining between the header and the ceiling. When used in this fashion, however, the header assembly is preferably provided with a latch or brake arrangement which cooperates between the header 62 and a fixed part of the panel arrangement, such as the supports 36, to create a positive securement of the header in the raised position to hence maintain the header in contacting engagement with the ceiling. Such latch arrangement may be of a type which is actuated by the installer at the time of installation, and for example may involve a resiliently-urged pawl or similar holding element carried on the header and ratcheting upwardly along a rack structure formed on the support member to maintain the header in a raised position. Alternatively, in situations where a "kiss" relationship is desired, the header assembly can be provided with springs which react between the supports 36 and the header member 62 so as to urge the header member 62 upwardly into contacting engagement with the ceiling. When using springs, however, the springs will require use of a separate hold-down or locking member which will normally maintain the header in the retracted position until the hold-down is manually released to permit upward extension of the header during installation of the panel.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In an upright wall system including at least two prefabricated full-height wall panels joined in adjacent edge-to-edge relationship, said wall panels being supported on a floor and projecting upwardly to a point wherein upper edges thereof are disposed in close proximity to a ceiling, and a header arrangement associated with each said prefabricated wall panel for creating an engaged relationship with a ceiling track to provide lateral stability at the upper edge of the respective wall panel, the improvement comprising:

said prefabricated wall panel having a horizontally elongate rigid top frame member extending lengthwise along and defining an upper edge thereof;

said header arrangement including a guide structure fixed to said top frame member and projecting upwardly therefrom;

said header arrangement also including an elongate header member disposed above said top frame member and extending lengthwise therealong, said header member having a downwardly-opening channel-shaped cross-section which downwardly telescopes over and is vertically slidably supported on said guide structure for upward vertical movement from a lowered storage position into a raised installed position;

said header member having an engagement structure which creates a fixed but releasable engagement with the ceiling track when the header member is in the raised installed position, said header member being manually displaced from said lowered position into said raised installed position.

2. A wall system according to claim 1, wherein the prefabricated wall panel includes a pair of horizontally elongate trim parts which are fixedly attached to said top frame member adjacent opposite sides thereof and which project upwardly therefrom to define a lengthwise-extending channel therebetween, said guide structure and said header member being disposed substantially entirely within said channel when said header member is in said lowered position.

3. A wall system according to claim 2, wherein said guide structure includes a guide member fixed to a top wall of said top frame member adjacent each end thereof, said guide member being defined by a channel-shaped member having upwardly projecting side legs which are spaced inwardly from the respective sidewardly-adjacent trim parts, and said header member having downwardly-protruding side legs which are vertically sidewardly engaged with exterior sides of the respective side legs of the guide members.

4. A wall system according to claim 3, wherein said engagement structure includes a pair of manually-movable fasteners mounted on one side leg of said header member adjacent opposite ends thereof and being manually movable so as to protrude inwardly for gripping engagement with a side wall associated with a ceiling track to effect fixed engagement of the header member to the ceiling track.

5. A wall system according to claim 4, wherein each side leg of the header member has a pair of said manually-movable fastener members mounted thereon adjacent opposite ends thereof, the fastener members as provided adjacent each end of the header member being mounted on the respective side legs in generally opposed and aligned relationship with respect to one another.

6. A wall system according to claim 4, wherein the fastener member comprises a manually-rotatable threaded screw which is disposed in rotatable threaded engagement with the respective side leg of the header member and has a free end positioned for engagement with the side flange of the ceiling track.

7. A wall system according to claim 2, wherein the header member includes a pair of horizontally elongate sealing strips mounted thereon in generally parallel relationship adjacent opposite upper sides thereof for engagement with the ceiling adjacent opposite sides of the track when the header member is in the raised installed position.

8. A wall system according to claim 7, wherein the header member includes a second pair of horizontally elongate sealing strips mounted thereon in generally parallel relationship and positioned adjacent opposite lower sides thereof for engagement with the respective trim parts when the header member is in the raised installed position.

9. A wall system according to claim 7, wherein the header member has a top wall provided with a depressed channel extending longitudinally along the centerline thereof, said engagement structure including a resiliently deflectable engagement clip secured within said depressed channel adjacent each end of said header member and resiliently engaged with the ceiling track when the header member is in the raised installed position, and said pair of sealing strips being mounted on and protruding upwardly from said top wall adjacent opposite sides of said depressed channel.

10. A prefabricated full-height wall panel for upright disposition on a floor and engagement with a ceiling adjacent an upper edge thereof, said wall panel comprising:

a rigid ring-shaped exterior frame having a horizontally elongate top frame arrangement extending along an upper edge thereof;

said top frame arrangement including a horizontally elongate top frame member and a pair of elongate side trim parts which are fixedly related to said top frame member and extend therealong adjacent opposite sides thereof, said top frame member and said side trim parts defining a generally upwardly-opening channel-shaped configuration which defines an elongate space located above the top frame member and sidewardly between the trim parts;

a guide structure disposed within said space and fixedly attached to said top frame member; and a horizontally-elongated header member vertically slidably supported on said guide structure and normally maintained in a lowered storage position wherein said header member is disposed within said space, said header member being manually slidable upwardly on said guide structure into a raised position wherein the header member protrudes upwardly from said space above the adjacent trim parts for engagement with the ceiling;

the header member having a pair of side walls which are cantilevered downwardly in generally parallel relationship in sideward straddling and slidably supporting engagement with said guide structure, and an engagement structure carried on each of said side walls and protruding inwardly thereof for creating a fixed engagement with side flanges defined on a ceiling track when the header member is moved upwardly to create an engaged relationship with the track, said engagement structure as associated with at least one of said header member side walls including first and second manually-movable fasteners which are carried on the respective side wall adjacent opposite ends thereof and which are manually movable inwardly away from the side wall for engagement with the track.

11. A wall panel according to claim 10, wherein the trim parts and the top frame member define an integral one-piece member.

12. A wall panel according to claim 10, wherein the manually-movable fasteners comprise threaded set screws which are rotatably and threadably engaged with the respective side wall and which when rotated protrude inwardly for engagement with a side wall of the ceiling track.

13. A wall panel according to claim 12, wherein both side legs of the header member have a pair of set screws rotatably carried thereon adjacent opposite ends thereof for effecting gripping engagement of the track therebetween in the vicinity of opposite ends of the header member.

14. A prefabricated full-height wall panel for upright disposition on a floor and engagement with a ceiling adjacent an upper edge thereof, said wall panel comprising:

a rigid ring-shaped exterior frame having a horizontally elongate top frame arrangement extending along an upper edge thereof;

said top frame arrangement including a horizontally elongate top frame member and a pair of elongate side trim parts which are fixedly related to said top frame member and extend therealong adjacent opposite sides thereof, said top frame member and said side trim parts defining a generally upwardly-opening channel-shaped configuration which defines an elongate space located above the top frame member and sidewardly between the trim parts;

a guide structure disposed within said space and fixedly attached to said top frame member; and a horizontally-elongated header member vertically slidably supported on said guide structure and normally maintained in a lowered storage position wherein said header member is disposed within said space, said header member being manually slidable upwardly on said guide structure into a raised position wherein the header member protrudes upwardly from said space above the adjacent trim parts for engagement with the ceiling;

said header member having a downwardly opening channel-shaped cross-section, said header member having a top wall with a downwardly-directed channel-shaped depression formed therein and extending lengthwise therealong, said depression enabling the header member to move upwardly a significant extent so that a track fixed to the ceiling protrudes into the depression;

a pair of spring clips being mounted on said header member within said depression in spaced relationship therealong, said clips being engaged with the ceiling track when the header member is in the raised position to create lateral restraint at the upper edge of the panel.

15. A wall panel according to claim 14, wherein a pair of generally parallel and elongate upper seal strips are fixed to said top wall of said header member adjacent opposite sides of said depression for engagement with the ceiling adjacent opposite sides of the track.

16. A wall panel according to claim 15, wherein a pair of lower sealing strips are fixed to opposite lower sides of said header member and extend lengthwise therealong for engagement with inner side surfaces of said trim members when said header member is in said raised position.

17. A wall panel according to claim 14, wherein the trim parts are separate elongate members which are fixedly attached to said top frame member.

18. A process for installing a prefabricated full-height wall panel between a floor and a ceiling, comprising the steps of:

providing a prefabricated full-height wall panel having a top frame member extending along an upper edge thereof;

providing a pair of horizontally elongate trim parts stationarily attached to said top member adjacent opposite upper sides of said top frame member so that said trim parts are laterally sidewardly spaced apart and define an elongate upwardly-opening channel-like space extending lengthwise therebetween;

positioning a guide structure above said top frame member and fixedly attaching said guide structure to said top frame member in inwardly spaced relation between exterior sides of the top frame member;

providing a horizontally elongate channel-shaped header member having a downwardly-opening channel-shaped cross-section;

positioning said header member in an inverted downward-opening orientation, and positioning said header member downwardly over said guide structure so that said header member fits substantially entirely within said channel-like space while telescoping over and being vertically slidably supported on the guide structure;

then vertically swinging the panel member from a non-vertical orientation upwardly into a vertical orientation so that the header member is disposed generally parallel with but spaced downwardly a small distance below a track which is fixed to the ceiling; and then manually slidably moving the header member upwardly out of said space into a raised position and attaching the header member to the track.

* * * * *